United States Patent [19]

Yoshida et al.

[11] Patent Number: 4,723,965

[45] Date of Patent: Feb. 9, 1988

[54] MOTOR GASOLINE COMPOSITIONS

[75] Inventors: Eiichi Yoshida, Yokohama; Hirotsugu Nomura, Chigasaki; Shoichi Satoh, Yokohama, all of Japan

[73] Assignee: Nippon Oil Co., Ltd., Tokyo, Japan

[21] Appl. No.: 822,032

[22] Filed: Jan. 24, 1986

[30] Foreign Application Priority Data

Jan. 31, 1985 [JP] Japan ..... 60-17120

[51] Int. Cl.[4] ..... C10L 1/18

[52] U.S. Cl. ..... 44/78; 44/70

[58] Field of Search ..... 44/70, 78

[56] References Cited

U.S. PATENT DOCUMENTS

| | | | |
|---|---|---|---|
| 2,956,870 | 10/1960 | Heisler et al. | 44/70 |
| 3,232,724 | 2/1966 | Finnigin et al. | 44/78 |
| 3,320,041 | 5/1967 | Hemmingway | 44/70 |
| 3,542,680 | 11/1970 | LeSuer | 44/70 |

*Primary Examiner*—William R. Dixon, Jr.
*Assistant Examiner*—Ellen M. McAvoy
*Attorney, Agent, or Firm*—Bucknam and Archer

[57] ABSTRACT

A motor gasoline composition for use in automotive vehicles is disclosed. A selected gasoline fraction is admixed with a specified amount of a selected phthalate diester whereby spark plugs can be protected from fouling.

5 Claims, No Drawings

MOTOR GASOLINE COMPOSITIONS

BACKGROUND OF THE INVENTION

1. Field of the Invention

This invention relates to motor gasoline compositions suitable for use in automotive vehicles.

2. Prior Art

Spark plugs are susceptible to fouling in automobile engines particularly where lead-free gasoline is used. Plug fouling is the phenomenon in which the spark plugs are covered with deposits at their insulator legs and electrodes and which is more likely to occur during cold winter season. Plug fouling causes starting difficulty and unstable operation of the engines at low speed, and further invites insufficient acceleration.

It is known that plug fouling takes place more frequently the higher in aromatics contents and the heavier the lead-free gasoline.

This problem has been coped with by using spark plugs of high quality as regards their construction and thermal value, or by avoiding prolonged operation of engines in an excessively rich air-fuel mixture. A keen demand has been voiced for improved means capable of protecting spark plugs from fouling without resort to modifications of the construction and operation of spark plugs per se.

As stated above, lead-free gasoline fuels of a composition having high aromatics content and heavy characteristics are responsible for fouled spark plugs in the automobile engine. Although the gasoline composition of the invention is also similar in these characteristics, it has now been found that the same gasoline composition when admixed with specific phthalate diesters can eliminate spark plug fouling.

In the meantime, agents other than conventional alkylated lead have been proposed to increase the octane number of motor gasolines. It has also been proposed to this end to modify the hydrocarbon composition of gasoline itself, for example with use of high aromatic components so as to attain an octane number as high as 95 or even higher than 98. The gasoline composition of the invention can be of this high octane class, and yet is free from spark plug fouling.

The present invention seeks to provide a novel gasoline composition which is effective in particular for inhibiting spark plug fouling.

This and other objects and advantages of the invention can be achieved by the provision of a gasoline composition for automotive fuel which comprises a gasoline fraction having an aromatics content of greater than 35 volume percent and a 50 percent distillation temperature of 85° to 125° C., and a specified amount of a selected phthalate diester.

DETAILED DESCRIPTION OF THE INVENTION

By the term "gasoline fraction" as used herein is meant petroleum fractions distilling at temperatures of about 35° to 200° C., specific examples of which are gasolines for automobile engines stipulated by the Japanese Industrial Standards (JIS) K2202. The present invention contemplates the use of gasoline fractions having an aromatics content of greater than 35 volume percent, preferably 35 to 50 volume percent, and a 50 percent distillation temperature of 85° to 125° C. The aromatics contents are those measured in accordance with JIS K2536 for the Testing Method for Hydrocarbon Types in Petroleum Products by Fluorescent Indicator Adsorption. The 50 percent distillation temperatures are those measured in accordance with JIS K2254 for the Testing Method for Distillation of Petroleum Products.

Phthalate diesters eligible for the purpose of the invention are those represented by the formula

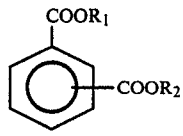

where $R_1$ and $R_2$ are each an alkyl group of 1 to 8 carbon atoms, preferably 1 to 4 carbon atoms, $R_1$ and $R_2$ being identical or different. Examples of $R_1$ and $R_2$ in the aforesaid formula are methyl, ethyl, propyl, butyl, pentyl, hexyl, heptyl and octyl groups. Such phthalate diesters are obtainable for example by esterifying o-phthalic acid, m-phthalic acid, p-phthalic acid and their acid halides with aliphatic, saturated monovalent alcohols of 1 to 8 carbon atoms.

The phtalate diesters contemplated by the invention include for example dimethyl phthalate, diethyl phthalate, dipropyl phthalate, dibutyl phthalate and the like, and combinations thereof.

The amount of each of the above described phthalate diesters to be added is in the range of 0.05 to 5.0 weight percent, preferably 0.2 to 1.0 weight percent based on the gasoline fraction. Smaller amounts would fail to provide sufficient protection of spark plugs against fouling, while larger amounts would produce no better results but would only lead to lower production economy.

The gasoline composition of the invention which contains either of the phthalate diesters can be charged as it is into the fuel tank. Alternatively, it is possible to charge a predetermined amount of a given phthalate diester into the fuel tank which has already been filled with the gasoline.

There may be used other additives such as antioxidants, metal deactivators, surfactants, fuel aids, antistatic agents, dyes and the like.

To provide improved octane number, there may also be used ethers such as methyl-t-butylether and isopropyl-t-butylether, and alcohols such as methanol, ethanol, isopropanol and tert-butanol. The amounts of these ethers and alcohols to be added are optional, generally in the range of 1 to 60 weight parts, normally in the range of 1 to 25 weight parts per 100 weight parts of the gasoline composition.

The invention will be further described by way of the following examples, in which the gasoline compositions of the invention and the conventional gasoline fuels were subjected to the performance test described below.

PERFORMANCE TEST

A test car equipped with new spark plugs of the manufacturer's specification was started on a chassis dynamometer at a room temperature of 0° C. and accelerated and decelerated alternately every two minutes. This mode of operation was repeated three times, whereupon the car was stopped for a period of 54 minutes. This constitutes a cycle of test run. The car was brought to a stop upon completion of 10 cycles for visual inspection of each set of spark plugs associated with each of the tested gasoline compositions. The car was in other instances stopped immediately after it failed to accelerate, the number of test run cycles being counted, and the spark plugs were likewise inspected. The results of these performance tests are shown in Table 1.

EXAMPLE 1 AND COMPARISON EXAMPLE 1

To a lead-free gasoline fraction having an aromatics content of 42 vol. % and a 50% distillation temperature of 110° C. was added 0.5 wt. % of o-diethyl phthalate thereby to produce a gasoline composition according to the invention. The resulting composition was supplied as a test fuel to a test car of 1,800 cc displacement equipped with an injection type fuel supplying system and an automatic transmission.

The gasoline composition of the invention and that of a conventional type devoid of o-diethyl phthalate were both tested with the results shown in Table 1.

Examples 2 and 3 and Comparison Examples 2 and 3.

The details as regards the gasoline compositions of the invention and those of controls are as shown in Table 1 together with test results.

TABLE 1

| | | | Example 1 | Comparison Example 1 | Example 2 | Comparison Example 2 | Example 3 | Comparison Example 3 |
|---|---|---|---|---|---|---|---|---|
| Test gasoline | Properties | Aromatics content* (vol. %) | 42 | Same as in Example 1 | 50 | Same as in Example 2 | 46 | Same as in Example 3 |
| | | 50% Distillation temperature** (°C.) | 110 | | 112 | | 98 | |
| | Phthalate diester | Type | o-Diethyl phthalate | — | o-Diethyl phthalate | — | o-Dipropyl phthalate | — |
| | | Amount (wt. %) | 0.5 | | 0.7 | | 0.5 | |
| Performance test | Test car | Carburetor/ Injector | Injector | Same as in Example 1 | Carburetor | Same as in Example 2 | Carburetor | Same as in Example 3 |
| | | Transmission | Automatic | | Manual | | Manual | |
| | | Displacement (cc) | 1,800 | | 1,300 | | 1,600 | |
| | Number of test cycles at which acceleration failed | | >10 | 7 | >10 | 3 | >10 | 4 |
| | Appearance of spark plugs*** | | Normal | Fouling | Normal | Fouling | Normal | Fouling |

*Determined in accordance with JIS K2536
**Determined in accordance with JIS K2254
***Normal: Insulator legs remained light brown or greyish white
Fouling: Insulator legs and electrodes covered with deposits It is to be noted that Examples 1 to 3 representing the invention are all satisfactory in respect of plug fouling inhibiting ability as evidenced by continued operation of the test car beyond 10 cycles of test run. Controls in Comparison Examples 1 to 3 encountered acceleration failure prior to 10 cycles of test run, resulting in fouled spark plugs.

What is claimed is:

1. A gasoline composition for automotive fuel which comprises a gasoline fraction havihg an aromatics content of greater than 35 volume percent and a 50 percent distillation temperature of 85° to 125° C., characterised by the addition of a phthalate diester in an amount of 0.2 to 5.0 weight percent based on said gasoline fraction, said phthalate diester being represented by the formula

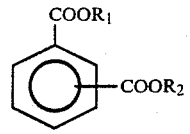

where $R_1$ and $R_2$ are each an alkyl group of 1 to 8 carbon atoms, $R_1$ and $R_2$ being identical or different.

2. A gasoline composition according to claim 1 wherein said phthalate diester is selected from the group consisting of dimethyl phthalate, diethyl phthalate, dipropyl phthalate, dibutyl phthalate and a combination thereof.

3. In an automotive engine which comprises spark plugs, the method of preventing said spark plugs from fouling, which consists of using with said automotive engine a gasoline fraction having an aromatics content between 35 volume percent and 50 volume percent and 50 percent distillation temperature of 85° to 125° C., and adding to said gasoline fraction a phthalate diester in an amount of 0.2 to 5.0 weight percent based on said gasoline fraction, said phthalate diester being represented by the formula

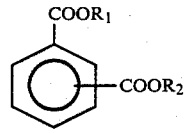

wherein $R_1$ and $R_2$ are each an alkyl group of 1 to 8 carbon atoms, $R_1$ and $R_2$ being identical or different.

4. The method according to claim 3 wherein said phthalate diester is a member selected from the group consisting of dimethyl phthalate, diethyl phthalate, dipropyl phthalate dibutyl phthalate and mixtures thereof.

5. The composition according to claim 1 wherein said gasoline fraction is a petroleum fraction of b.p. 35°-200° C.

* * * * *